US010260200B2

(12) United States Patent
Saikkonen et al.

(10) Patent No.: US 10,260,200 B2
(45) Date of Patent: Apr. 16, 2019

(54) YANKEE DRYING HOOD ARRANGEMENT, A YANKEE DRYING CYLINDER FITTED WITH A YANKEE DRYING HOOD ARRANGEMENT AND A METHOD OF DRYING A FIBROUS WEB

(71) Applicant: VALMET S.P.A., Milan (IT)

(72) Inventors: Olli Jaakko Antero Saikkonen, Gorizia (IT); Klavdij Lasic, Sempeter Pri Gorici (SI); Luca Moscatelli, Villa Vicentina (IT); Luigino Furlan, Udine (IT)

(73) Assignee: Valmet S.P.A., Milan (IT)

( * ) Notice: Subject to any disclaimer, the term of this patent is extended or adjusted under 35 U.S.C. 154(b) by 68 days.

(21) Appl. No.: 15/560,654

(22) PCT Filed: Apr. 19, 2016

(86) PCT No.: PCT/EP2016/058616
§ 371 (c)(1),
(2) Date: Sep. 22, 2017

(87) PCT Pub. No.: WO2016/169915
PCT Pub. Date: Oct. 27, 2016

(65) Prior Publication Data

US 2018/0094386 A1 Apr. 5, 2018

(30) Foreign Application Priority Data

Apr. 23, 2015 (EP) ..... 15164801

(51) Int. Cl.
*D21F 5/04* (2006.01)
*D21F 5/18* (2006.01)

(52) U.S. Cl.
CPC ..... *D21F 5/044* (2013.01); *D21F 5/181* (2013.01)

(58) Field of Classification Search
CPC ..... D21F 5/044; D21F 5/181
(Continued)

(56) References Cited

U.S. PATENT DOCUMENTS 5,383,288 A 1/1995 Ilmarinen
5,416,979 A * 5/1995 Joiner ..... D21F 5/044 34/114
(Continued)

FOREIGN PATENT DOCUMENTS

CA 2164501 C 4/1999
CN 1199797 A 11/1998
(Continued)

OTHER PUBLICATIONS

State Intellectual Property Office of the P.R.C., First Office Action for Application No. 201680023614.9, dated Oct. 8, 2018, 4 pages, China.
(Continued)

*Primary Examiner* — Stephen M Gravini
(74) *Attorney, Agent, or Firm* — Alston & Bird LLP

(57) ABSTRACT

The invention relates to a Yankee drying hood arrangement (1) which is shaped to be fitted over a Yankee drying cylinder (2) such that the drying hood arrangement (1) can cover a part (4) of the circular cylindrical surface (3) of a Yankee drying cylinder (2). The Yankee drying hood arrangement (1) comprises a plurality of nozzle boxes (5) distributed equidistantly around an imaginary axis (X) such that, when the Yankee drying hood arrangement (1) is fitted over a Yankee drying cylinder (2), the nozzle boxes (5) are spaced from the circular cylindrical surface (3) of the Yankee drying cylinder (2) but form a curved structure (6) that follows the outer contour of the circular cylindrical surface (3) of the Yankee drying cylinder (2). Each nozzle
(Continued)

box (5) has a longitudinal extension in a direction parallel to the axial extension of the Yankee drying cylinder (2) and each nozzle box (5) has openings (7) distributed along the longitudinal extension of the nozzle box (5) through which openings (7) a fluid such as hot air can exit the nozzle boxes (5) and stream towards the circular cylindrical surface (3) of the Yankee drying cylinder (2) at different points at different points along the axial extension of the Yankee drying cylinder (2). The Yankee drying arrangement further comprises a plurality of distributor conduits (8) for a fluid such as hot air and the distributor conduits (8) extend in the circumferential direction around the curved structure (6) formed by the nozzle boxes (5). Each distributor conduit (8) is in communication with several nozzle boxes (5) such that a fluid such as hot air can stream from each distributor conduit (8) to several different nozzle boxes (5). At least one main supply conduit (9, 10) for a fluid such as hot air is in communication with the distributor conduits (8) such that a fluid such as hot air can stream to the distributor conduits (8). The distributor conduits (8) are oriented around the curved structure (6) of the nozzle boxes (5) in such a pattern that, when one and the same distributor conduit (8) communicates with different nozzle boxes (5), it does so at different points along the longitudinal extension of the different nozzle boxes (5). The invention also relates to a Yankee drying cylinder fitted with the inventive Yankee drying hood arrangement and to a method of drying a fibrous web.

20 Claims, 12 Drawing Sheets

(58) Field of Classification Search
USPC ..... 34/444
See application file for complete search history.

(56) References Cited

U.S. PATENT DOCUMENTS 5,465,504 A * 11/1995 Joiner ..... D21F 5/044 34/111
5,619,808 A * 4/1997 Pabst ..... D06C 3/02 34/640
5,625,962 A * 5/1997 Fleissner ..... F26B 13/16 34/446
5,784,804 A 7/1998 Nowakowski
5,813,136 A * 9/1998 Meschenmoser ..... D21F 5/04 34/117
5,937,538 A * 8/1999 Joiner ..... D21F 5/044 34/114
6,006,443 A * 12/1999 Karvinen ..... D21F 7/008 34/446
6,006,444 A 12/1999 Baubock et al.
6,138,380 A * 10/2000 Veijola ..... D21F 5/044 34/111
6,490,813 B1 * 12/2002 Oechsle ..... D21F 5/00 162/198
7,249,424 B2 * 7/2007 Lipponen ..... D21F 7/003 162/198
8,117,765 B2 * 2/2012 Aaltonen ..... D21F 5/042 162/272
2018/0094386 A1 * 4/2018 Saikkonen ..... D21F 5/181

FOREIGN PATENT DOCUMENTS

CN 101487199 A 7/2009
CN 202401341 U 8/2012
EP 0699291 B1 5/1998
EP 2126203 B1 6/2012
EP 2963176 A1 * 1/2016 ..... D21F 5/044
EP 2963176 B1 * 3/2017 ..... D21F 5/044
WO WO 1995/027877 A1 10/1995
WO WO-0100925 A1 * 1/2001 ..... D21F 5/044
WO WO 2015/007482 A1 1/2015

OTHER PUBLICATIONS

State Intellectual Property Office of the P.R.C., Search Report for Application No. 201680023614.9, dated Sep. 25, 2018, 3 pages, China.
International Searching Authority, International Search Report and Written Opinion for International Application No. PCT/EP2016/058616, dated Jun. 20, 2016, 9 pages, Netherlands.

* cited by examiner

YANKEE DRYING HOOD ARRANGEMENT, A YANKEE DRYING CYLINDER FITTED WITH A YANKEE DRYING HOOD ARRANGEMENT AND A METHOD OF DRYING A FIBROUS WEB

CROSS REFERENCE TO RELATED APPLICATIONS

This application is a National Stage Application, filed under 35 U.S.C. 371, of International Application No. PCT/EP2016/058616, filed Apr. 19, 2016, which application further claims priority to European Application No. 15164801.1, filed Apr. 23, 2015; the contents of both of which are hereby incorporated by reference in their entirety.

BACKGROUND

Related Field

The invention relates to a Yankee drying hood arrangement and a Yankee drying cylinder fitted with a Yankee drying hood arrangement. The invention also relates to a method of drying a fibrous web.

Description of Related Art

Yankee drying cylinders are often equipped with a Yankee hood to increase the drying effect. The Yankee hood typically has an air supply system for supplying air that is sent against the paper web as the paper web travels over the cylindrical surface of the Yankee cylinder. The air that is supplied is heated such that it can contribute to achieve evaporation of the water that is present in the paper web. A common design of a Yankee hood is such that it comprises an enclosure, i.e. a box structure. One or several major air supply conduits are arranged to transport heated air to the enclosure. Inside the enclosure, distributor conduits connected to the major air supply conduits allow the heated air to be sent to nozzle boxes that are distributed around the Yankee drying cylinder and extend in the axial direction of the Yankee drying cylinder. The nozzle boxes form a curved structure around the periphery of the Yankee drying cylinder and they have openings facing the Yankee drying cylinder through which heated air can be sent towards the outer surface of the Yankee drying cylinder and thereby also against the paper web. An example of a Yankee hood system is disclosed in, for example, U.S. Pat. No. 5,784,804. A known way of arranging the distributor conduits is to place several such distributor conduits in parallel and let them follow the outer circumference of the curved structure formed by the nozzle boxes. The air that is supplied through the major supply conduits has been heated. The heating may occur before the air is sent into the enclosure of the Yankee hood but heating may also be arranged inside the enclosure of the Yankee hood. The inventors have found that the heating of the web caused by the hot air coming through the nozzle boxes may sometimes vary in the cross machine direction (the CD direction). This may in turn result in undesirable variations in dryness of the paper web across the widths of the paper web, i.e. a moisture profile that is less even than what is desired. To find good solutions to this problem has become more and more important. While a certain variation in moisture profile could be accepted in the past, current standards require more uniform performance and less variation in moisture profile. The object of the present invention is to provide a Yankee drying hood arrangement that is capable of achieving a more even heating in the cross machine direction and thereby an improved moisture profile.

BRIEF SUMMARY

The object of the invention is achieved by the inventive Yankee drying hood arrangement. The Yankee drying hood of the present invention is shaped to be fitted over (placed over) a Yankee drying cylinder that has an axial extension and a circular cylindrical surface such that the drying hood arrangement can cover a part of the circular cylindrical surface of the Yankee drying cylinder. The inventive Yankee drying hood arrangement comprises a plurality of nozzle boxes distributed around an imaginary axis such that, when the Yankee drying hood arrangement is fitted over a Yankee drying cylinder, the nozzle boxes are spaced from the circular cylindrical surface but form a curved structure that follows the outer contour of the circular cylindrical surface of the Yankee drying cylinder. Preferably, the nozzle boxes are equidistantly or substantially equidistantly spaced from the imaginary axis (i.e. they all have the same distance to the imaginary axis around which they are distributed) such that, when the Yankee drying hood arrangement is fitted over a Yankee drying cylinder, the distance from each nozzle box to the circular cylindrical surface of the Yankee drying cylinder is the same but embodiments are conceivable in which, when the Yankee drying hood arrangement is fitted over the drying cylinder, the distance from different nozzle boxes to the circular cylindrical surface of the Yankee drying cylinder varies slightly. Each nozzle box has a longitudinal extension in a direction parallel to the axial extension of the Yankee drying cylinder and each nozzle box has a plurality of openings distributed along the longitudinal extension of the nozzle box. Through the openings in the nozzle box, a fluid such as hot air can exit the nozzle boxes and stream towards the circular cylindrical surface of the Yankee drying cylinder at different points along the longitudinal extension of each nozzle box. Thereby, the fluid streaming from the openings can reach the circular cylindrical surface of the Yankee drying cylinder at different points along the axial extension of the Yankee drying cylinder. The inventive Yankee drying hood arrangement further comprises a plurality of distributor conduits for a fluid such as hot air. The distributor conduits extend in the circumferential direction around the curved structure formed by the nozzle boxes and each distributor conduit is in communication with several different nozzle boxes such that a fluid such as hot air can stream from each distributor conduit to several nozzle boxes. The Yankee drying hood arrangement also comprises at least one main supply conduit (a major supply conduit) for a fluid such as hot air. The main supply conduit is in communication with the distributor conduits such that a fluid such as hot air can stream from the at least one main supply conduit to the distributor conduits. According to the invention, the distributor conduits are oriented around the curved structure of the nozzle boxes in such a pattern that, when one and the same distributor conduit communicates with different nozzle boxes, it does so at different points along the longitudinal extension of the different nozzle boxes (i.e. at points spaced apart from each other in the direction of the longitudinal extension of the nozzle boxes).

In advantageous embodiments of the invention, the distributor conduits are helically oriented around the curved structure formed by the nozzle boxes. For example, the distributor conduits may be arranged such that, in the circumferential direction of the curved structure formed by nozzle boxes, the distributor conduits form an angle of 89°-60° or an angle of 88°-60° with the imaginary axis around which the nozzle boxes are distributed. In embodiments contemplated by the inventors, the distributor conduits may form an angle of 87°-70° with the imaginary axis around which the nozzle boxes are distributed. For example, they may form an angle of 80° with the imaginary axis around which the nozzle boxes are distributed.

In embodiments of the invention, the Yankee drying hood arrangement has at least two main supply conduits and each main supply conduit may be connected to its own set of distributor conduits.

The Yankee drying hood preferably comprises a box structure that at least partially encapsulates the nozzle boxes, the distributor conduits and the at least one main supply conduit. In embodiments having a box structure, the box structure preferably comprises a roof that covers the nozzle boxes, the distributor conduits and the at least one main conduit. Preferably (but not necessarily), the roof is curved such that, when the roof faces upwards, water or other liquids that land on the roof will be helped by gravity to flow off the roof. Advantageously, it may be convexly curved.

The nozzle boxes are preferably spaced apart from each other in the circumferential direction of the curved structure formed by the nozzle boxes such that a fluid such as air or a mixture of air and steam can pass between the nozzle boxes. Preferably, the nozzle boxes are spaced from each other by a distance of 30 mm-70 mm in the circumferential direction of the curved structure formed by the nozzle boxes.

Preferably, an evacuation conduit is arranged to evacuate fluid such as air or a mixture of air and steam from the Yankee drying hood arrangement and the evacuation conduit is preferably connected to a source of underpressure.

In many realistic embodiments of the invention, the curved structure formed by the nozzle boxes has a radius in the range of 1.5 m-3 m although other numerical values are also conceivable.

In embodiments of the invention, the Yankee drying hood arrangement may comprise 30-50 nozzle boxes.

In many realistic embodiments, the nozzle boxes have a length (extension) in the longitudinal direction of, for example, 2.0 m-10 m such that the curved structure formed by the nozzle boxes can cover the cylindrical outer surface of a Yankee drying cylinder having an axial extension of 2.0 m-10 m. In many practical embodiments, each nozzle box may comprise 100-300 openings per meter length in the longitudinal direction of the nozzle boxes although other numerical values are also conceivable.

In embodiments of the invention, each opening in the nozzle boxes has a diameter in the range of 2 mm-10 mm, preferably 3 mm-7 mm but other numerical values are also conceivable.

In embodiments of the invention, the Yankee drying hood arrangement may be designed in such a way that, in the circumferential direction of the curved structure formed by the nozzle boxes, the Yankee drying hood arrangement is divided into a first part and a second part. The first part may have, for example, 2-4 distributor conduits per meter width of the curved structure where the width of the structure is measured in the direction of the imaginary axis around which the nozzle boxes are distributed. The second part may have fewer distributor conduits per meter width of the curved structure. For example, the second part may have 1-2 distributor conduits per meter width of the curved structure. In such embodiments, the first part and the second part of the Yankee drying hood arrangement may have the same extension in the circumferential direction of the curved structure. The first part and the second part usually have the same number of nozzle boxes. However, embodiments are possible in which there is actually a larger number of nozzle boxes in one of the two parts than in the other. The first part may have a larger wrap angle over the Yankee drying cylinder than the second part but it may also be so that the second part has a larger wrap angle over the Yankee drying cylinder than the first part—or both the first and the second part may have the same wrap angle over the Yankee drying cylinder (i.e. they have the same length/extension in the circumferential direction). The division of the Yankee drying hood arrangement into a first part and a second part as such is traditional and the size of the first part in relation to the second part is often determined by the requirements of the machine configuration such as the location of, for example, the doctor blade used to crepe the fibrous web from the cylindrical surface of the Yankee drying cylinder or the location of any roll used to form a nip with the Yankee drying cylinder. The division of the two parts of the Yankee drying hood arrangement may also be determined or influenced by such considerations as the need to remove the Yankee drying hood from the Yankee drying cylinder.

The invention also relates to a Yankee drying cylinder which has been fitted with the inventive Yankee drying hood arrangement. The Yankee drying cylinder is then rotatably journalled such that it can rotate about an axis of rotation which coincides with the imaginary axis around which the nozzle boxes are distributed such that the nozzle boxes extend along the outer cylindrical surface of the Yankee drying cylinder and can deliver hot fluid towards the outer cylindrical surface of the Yankee drying cylinder along the axial extension of the Yankee drying cylinder.

DETAILED DESCRIPTION OF VARIOUS EMBODIMENTS

Figure 1:
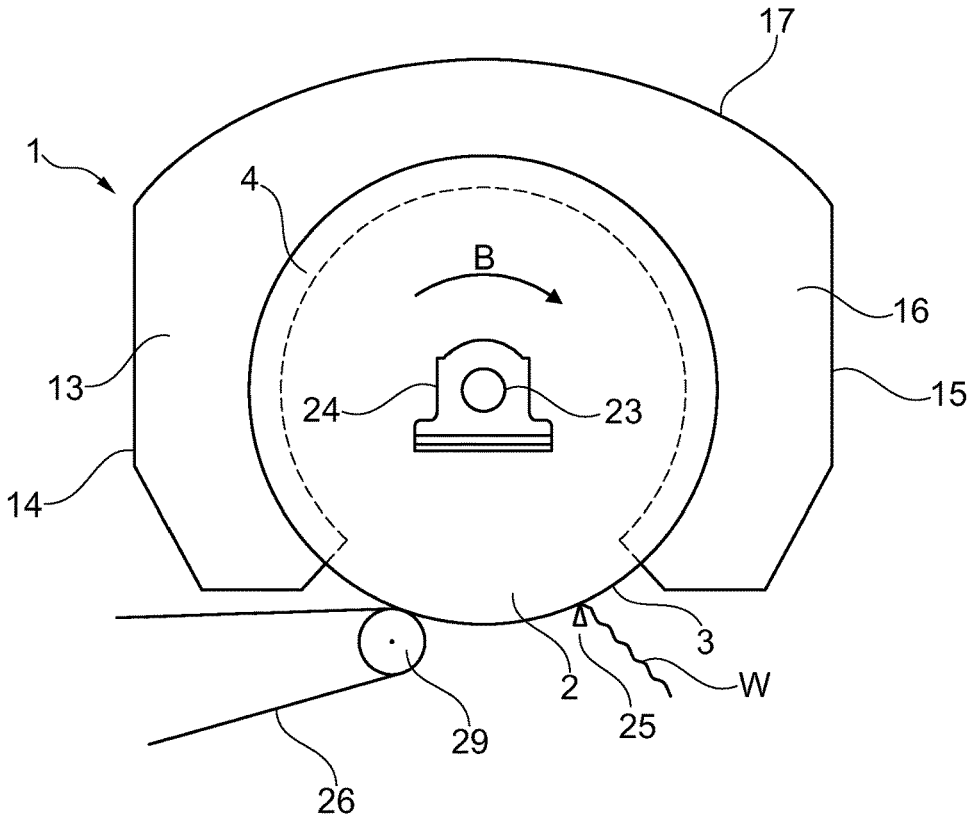
FIG. 1 is a schematic representation of a Yankee drying cylinder which is fitted with a Yankee drying hood according to the invention.
Figure 2:
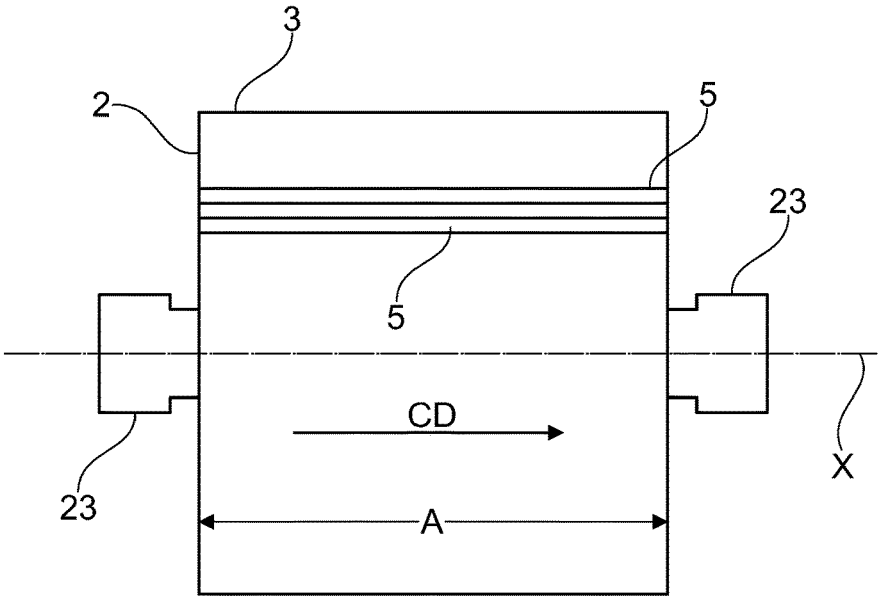
FIG. 2 is a schematic representation of the Yankee drying cylinder of FIG. 1 showing the Yankee drying cylinder along its axial extension.

With reference to FIG. 1, a Yankee drying cylinder 2 is shown. The Yankee drying cylinder is arranged to dry a wet fibrous web W that is coming from a forming section (not shown) carried by a fabric 26 which may be a fabric used in the forming section. The fabric 26 may be, for example, a felt or an impermeable band. The fabric 26 may possibly (but not necessarily) be a fabric which is also used as a forming fabric. A roll 29 within the loop of the fabric 26 may form a press nip and/or a transfer nip with the Yankee drying cylinder 2. The roll 29 may be, for example, a suction roll, a solid roll, a deflection compensated roll or an extended nip roll such as a shoe roll. Such arrangements for carrying the fibrous web to the Yankee drying cylinder 2 are known as such in the art of paper making and need not be described in greater detail. The exact method used for carrying the fibrous web W to the Yankee drying cylinder does not form a part of the present invention but is included only to further clarify the overall context of the invention. The Yankee drying cylinder can take many different forms. For example, the Yankee drying cylinder 2 may be a cast iron Yankee cylinder or a Yankee drying cylinder of welded steel as disclosed in for example European patent No. 2126203. In principle, the fibrous web W may be any kind of fibrous web W such as a paper web or a board web but it may in particular be a tissue paper web and it is expected that the present invention will be used at least primarily for tissue paper webs, for example webs W that are intended for toilet paper, facial towel, kitchen towel or the like. Such tissue paper grades may often have a basis weigh in the range 10 $g/m^2$-50 $g/m^2$ although basis weight values outside this range may also be conceivable. Very often, basis weigh may lie in the range of 15 $g/m^2$-30 $g/m^2$. Depending on the end user's needs, virgin pulp or recycled may be used. The pulp used for such grades may be based on hardwood or softwood. Hardwood fibers may come from, for example, Eucalyptus fibers or Acacia fibers but other raw materials are also well known. The Yankee drying cylinder 2 is heated such that water in the fibrous web W will evaporate when the fibrous web passes over the external surface 3 of the Yankee drying cylinder 2. The surface of the Yankee drying cylinder is cylindrical and the Yankee drying cylinder 2 is normally heated from the inside by hot steam which is fed into the Yankee drying cylinder in ways that are well known to those skilled in the art. When the steam inside the Yankee drying cylinder 2 condensates, the heat energy is transferred to the circular cylindrical surface 3 of the Yankee drying cylinder such that water in a web W that travels over the Yankee drying cylinder 2 is evaporated. In FIG. 1, the direction of rotation of the Yankee drying cylinder 2 is indicated by the arrow B as being "clockwise". With further reference to FIG. 1, the finally dried web W can be taken off the Yankee drying cylinder 2 by a device such as, for example, a doctor blade 25 as is known in the art. The fibrous web W may then be taken to a reel-up as is known in the art. The design of the reel-up and the way in which the fibrous web W is brought to the reel-up do not form a part of the present invention but the reel-up is mentioned to further clarify the overall context of the invention. The Yankee drying cylinder 2 is normally rotatably journalled in some kind of bearings 24 in which journals 23 of the Yankee drying cylinder 2 can be journalled to permit rotation of the Yankee drying cylinder about an axis of rotation X (see FIG. 2). It should be understood that the bearings 24 are supported by a supporting structure (not showed). The Yankee drying cylinder 2 is shown in FIG. 2 along its axial extension, i.e. the cross machine direction which is indicated by CD in FIG. 2. As can be seen in FIG. 2, the Yankee drying cylinder has a cylindrical outer surface 3 and an axial extension/length A and when it is journalled in the bearings 24, it can rotate about its axis of rotation X during operation. In FIG. 2, two of the nozzle boxes 5 are also shown. It should be understood that the inventive Yankee drying hood arrangement normally comprises more than just two nozzle boxes 5 and the inclusion of the two nozzle boxes 5 in FIG. 2 only serve to illustrate that the nozzle boxes 5 have a longitudinal extension/length that substantially corresponds to the axial extension A of the Yankee drying cylinder 2.

When a Yankee drying hood arrangement is fitted to a Yankee drying cylinder, the Yankee drying hood arrangement actually gives a very large contribution to the actual drying/evaporation effect. Of course, the exact contribution given by the Yankee hood drying arrangement in relation to the Yankee drying cylinder itself may vary depending on the circumstances of each specific case but in modern tissue machines having a hood that supplies heated air at a temperature of about 500° C., it may actually be so that the share of the evaporation that comes from the Yankee drying hood arrangement amounts to something on the order of 65%-70% while the Yankee drying cylinder itself contributes about 30%-35%. In view of this, the design of the Yankee drying hood arrangement may be very important for the final result. In this context, it should be remembered that the general trend for tissue machines is that they are usually designed for higher and higher speeds and as speed increases, the extra drying effect provided by the Yankee drying hood arrangement becomes increasingly important. In at least one tissue machine used today, the machine speed may be over 2200 meters/minute. In many realistic embodiments, the inventive Yankee drying hood arrangement could be used in machines operating at speeds in the range of 800 meter/minute-2200 meters per minute but other machine speeds are also conceivable. For example, in view of the trend towards higher speeds, the invention could be used for machines for higher speeds than 2200 meters/minute, for example 2400 meter/minute or higher and it is believed that even higher speeds will just make the invention even more useful.

Figure 6:
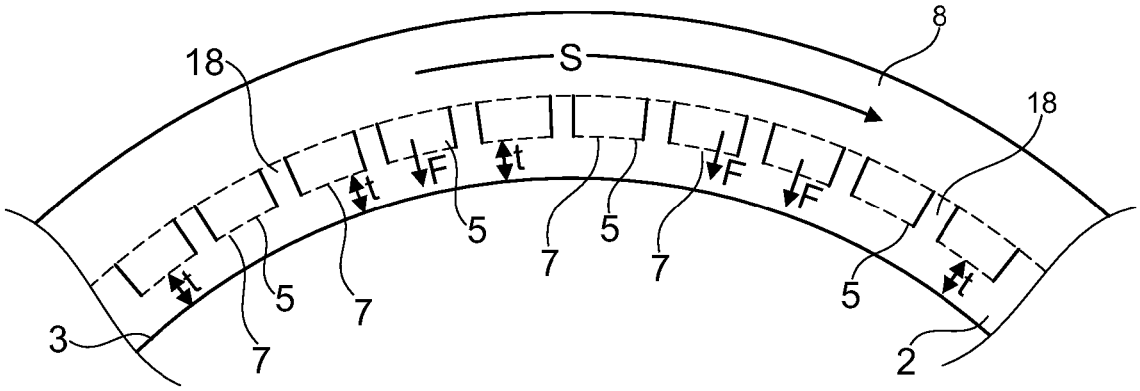
FIG. 6 is a schematic representation of some of the nozzle boxes seen from the side that will face the cylindrical surface of the Yankee drying cylinder when the Yankee drying hood arrangement is mounted on the Yankee drying cylinder.
Figure 7:
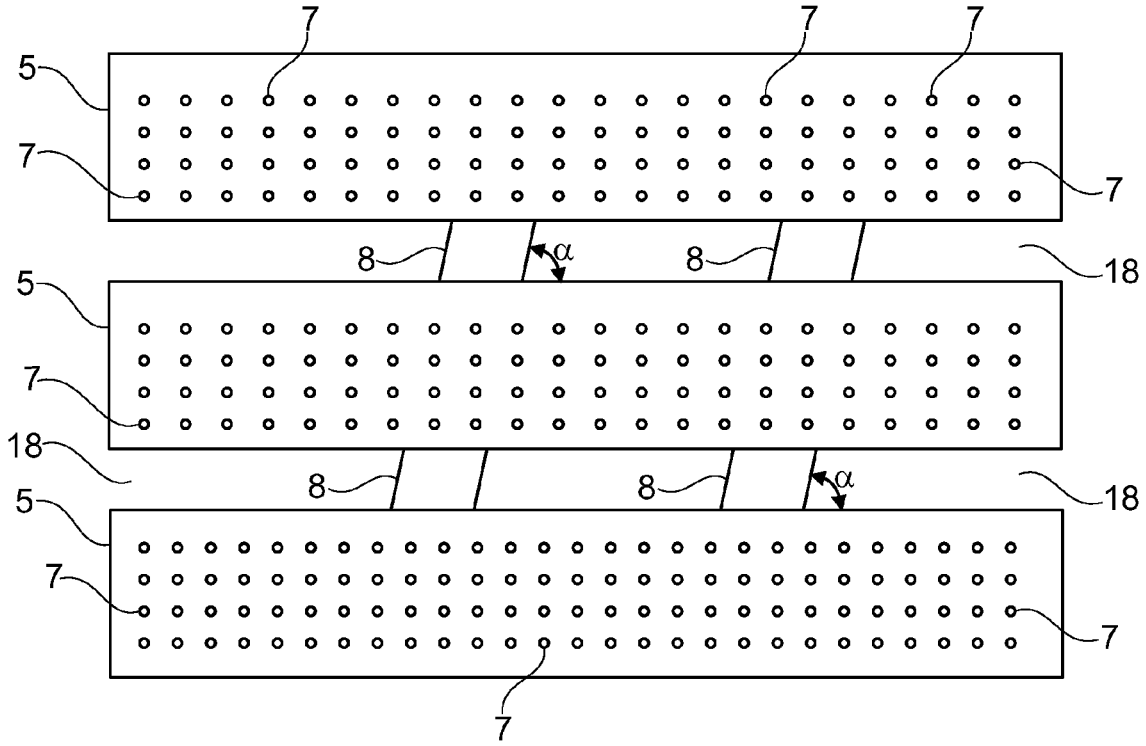
FIG. 7 is a schematic representation of some of the nozzle boxes as seen from the direction of the outer surface of the Yankee drying cylinder.
Figure 12:
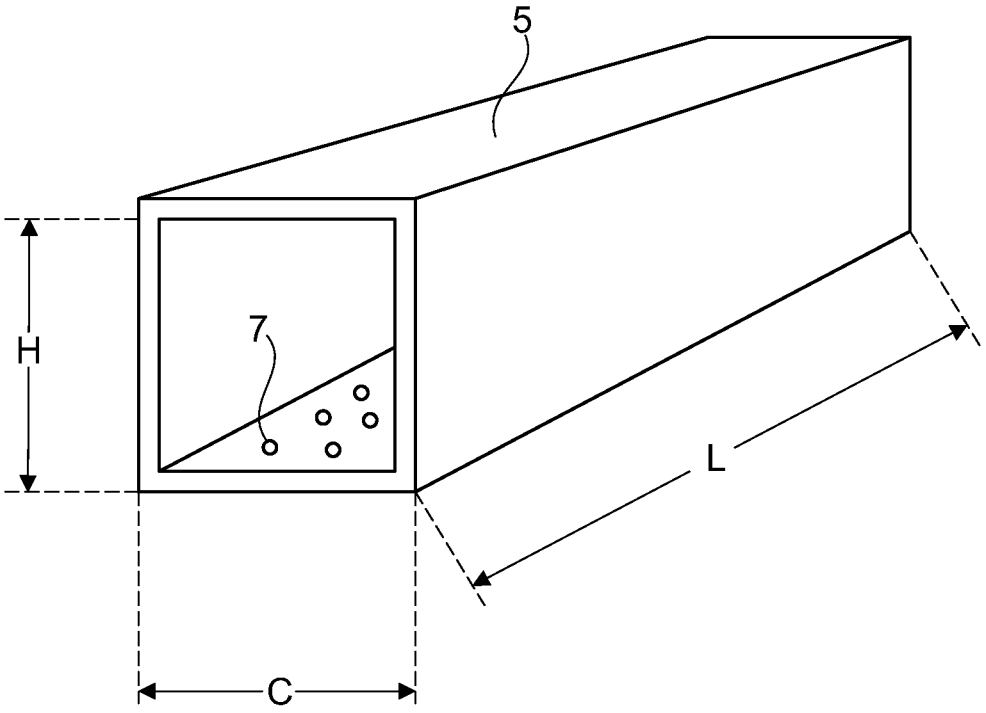
FIG. 12 is a perspective view of a nozzle box.

The inventive Yankee drying hood arrangement 1 is shaped to be fitted over a Yankee drying cylinder 2 such that the drying hood arrangement 1 can cover a part 4 of the circular cylindrical surface 3 of the Yankee drying cylinder 2. In FIG. 1, the part 4 of the Yankee drying cylinder 2 which for the moment is covered by the Yankee drying hood arrangement 1 is indicated by a broken line. Of course, as the Yankee drying cylinder 2 rotates during operation, different parts 4 will be covered at different points in time. With reference to FIG. 2, FIG. 3, FIG. 4 and FIG. 6, the Yankee drying hood arrangement 1 comprises a plurality of nozzle boxes 5 distributed around an imaginary axis X such that, when the Yankee drying hood arrangement 1 is fitted over the Yankee drying cylinder 2, the nozzle boxes 5 are spaced from the circular cylindrical surface 3 of the Yankee drying cylinder 2 but form a curved structure 6 that follows the outer contour of the circular cylindrical surface 3 of the Yankee drying cylinder 2. In practice, the imaginary axis X will coincide with or substantially coincide with the axis of rotation X of the Yankee drying cylinder 2 such that, for practical purposes, the imaginary axis X and the axis of rotation can be regarded as the same axis X when the Yankee drying hood arrangement 1 is mounted on the Yankee drying cylinder 2 and the Yankee drying cylinder 2 and Yankee drying hood arrangement 1 are ready for use. With reference to FIG. 4, the nozzle boxes 5 are equidistantly distributed around the imaginary axis X such that they all have the same distance to the imaginary axis X and the nozzle boxes 5 together form the curved structure 6 which is centered around the imaginary axis X. Thereby, the distance "t" (see FIG. 6) from a nozzle box 5 to the circular cylindrical surface 3 will be the same for all nozzle boxes 5. In many realistic embodiments of the invention, the nozzle boxes 5 are distributed around the imaginary axis X such that they are equidistantly or substantially equidistantly spaced from the imaginary axis X but embodiments are conceivable in which at least one nozzle boxes 5 is slightly closer to the imaginary axis X than other nozzle boxes 5 such that, when the Yankee drying hood arrangement is fitted over a Yankee drying cylinder 2, the distance "t" from at least one nozzle box 5 to the circular cylindrical surface 3 of the Yankee drying cylinder 2 is somewhat smaller than or somewhat larger than what it is for the other nozzle boxes 5. When the Yankee drying hood arrangement 1 is fitted on a Yankee drying cylinder 2, the imaginary axis X will coincide with or substantially coincide with the axis of rotation X of the Yankee drying cylinder 2. As can be seen in FIG. 2, the nozzle boxes 5 have a longitudinal extension/length in a direction parallel to the axial extension/length A of the Yankee drying cylinder 2 when the Yankee drying hood arrangement is fitted on the Yankee drying cylinder (see also FIG. 12 in which the longitudinal extension of a nozzle box is indicated by the symbol "L"). In preferred embodiments, the nozzle boxes 5 have such a longitudinal extension/length that is sufficient to cover the entire axial extension/length A of the Yankee drying cylinder or at least substantially the entire axial extension/length A of the Yankee drying cylinder 2 (as indicated in FIG. 2). In many realistic embodiments, the longitudinal ends of the nozzle boxes 5 may lie in the same plane. It will be understood that the curved structure 6 which is formed by the nozzle boxes 5 also has a longitudinal extension in the same direction as the longitudinal extension of the nozzle boxes 5. With further reference to FIG. 6, FIG. 7 and FIG. 12, each nozzle box 5 has a plurality of openings 7 distributed along the longitudinal extension L of the nozzle box 5 (see FIG. 12) through which openings 7 a fluid such as hot air can exit the nozzle boxes 5 and stream towards the circular cylindrical surface 3 of the Yankee drying cylinder 2 at different points along the longitudinal extension L of each nozzle box 5 such that the fluid streaming from the openings 7 can reach the circular cylindrical surface 3 of the Yankee drying cylinder 2 at different points along the axial extension/length A of the Yankee drying cylinder 2.

Figure 10:
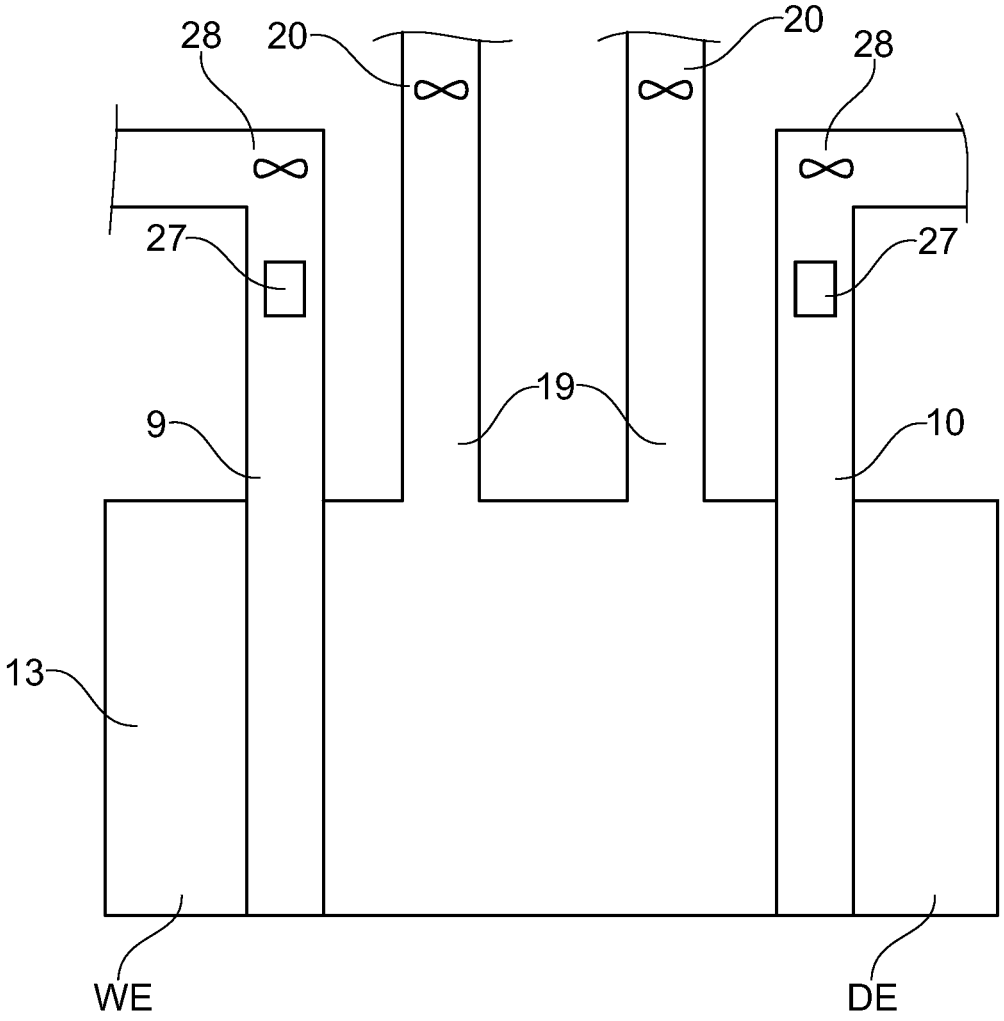
FIG. 10 is a schematic representation of the system for supplying and evacuating a fluid such as hot air to and from the Yankee drying hood arrangement.

With reference to FIG. 10, it can be seen how heaters 27 (for example burners) are arranged in the fluid supply system leading to the main supply conduit 9 or the main supply conduits 9, 10 and fans or equivalent elements 28 are arranged to blow the hot fluid (in particular hot air, gas or a mixture of hot air and other hot gases) into the main supply conduit(s) 9, 10. It should be understood that embodiments with only one main supply conduit 9 are conceivable.

Figure 3:
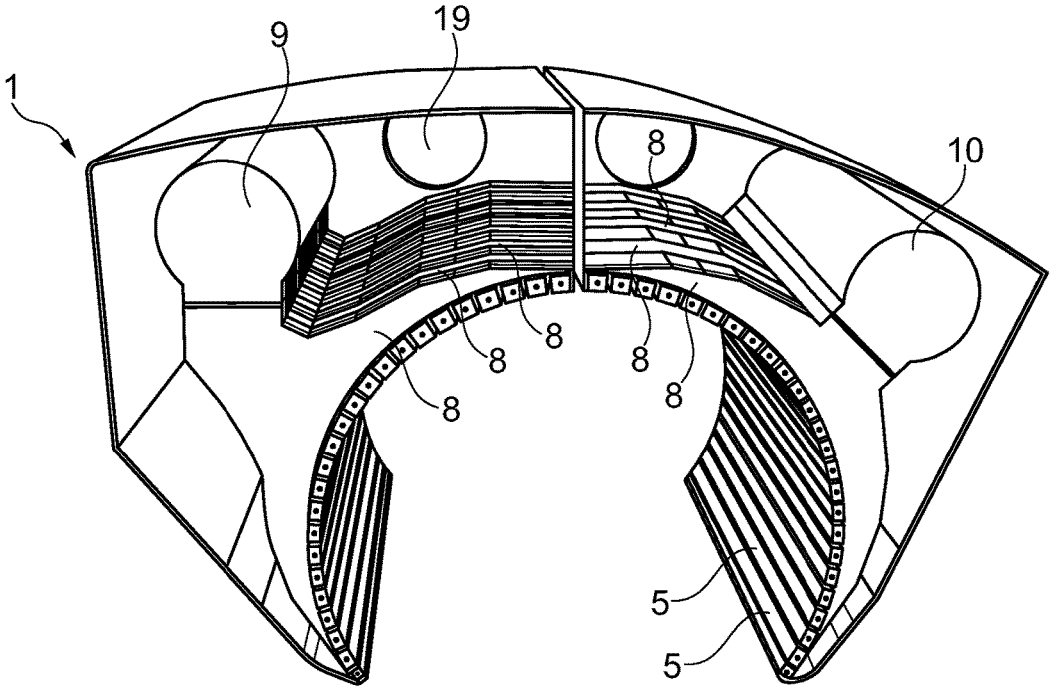
FIG. 3 is a perspective view that shows parts of the inventive Yankee drying hood arrangement.
Figure 4:
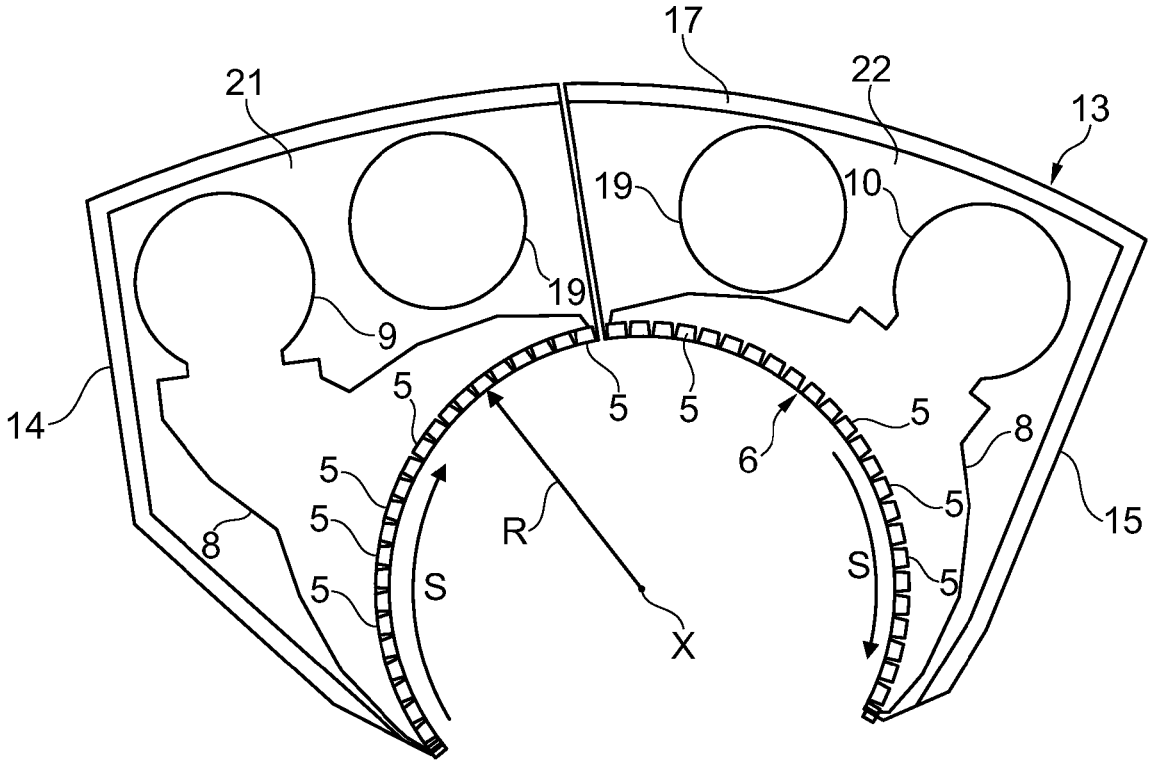
FIG. 4 is a cross-sectional side view of the inventive Yankee hood drying arrangement.
Figure 5:
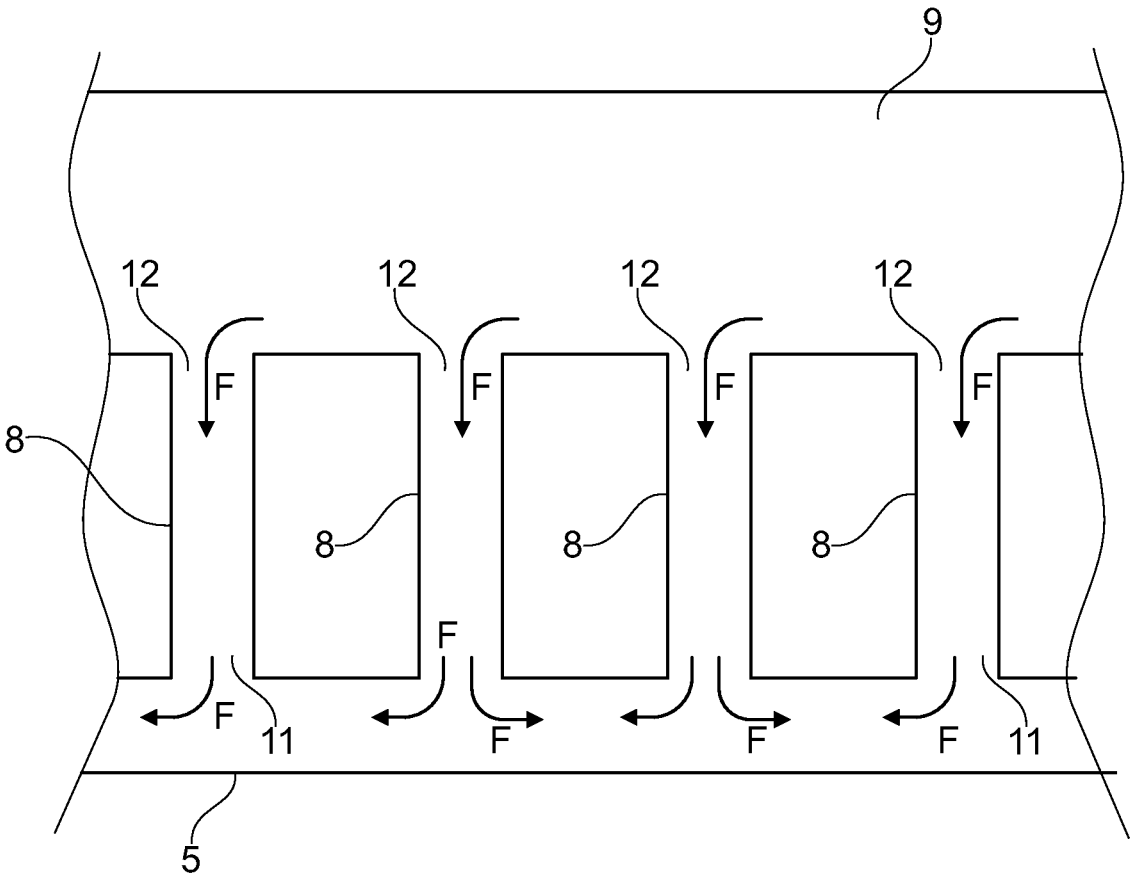
FIG. 5 is a schematic representation of how a fluid such as hot air may flow from the at least one main supply conduit via distributor conduits to a nozzle box.

With reference to FIG. 3, FIG. 4, FIG. 5 and FIG. 6, it can be seen how a stream F of hot gases (e.g. air) can come through the main supply conduit(s) 9, 10 and go from the main supply conduit(s) 9, 10 via openings/entry points 12 into the distributor conduits 8 (see FIG. 5). From the distributor conduits 8, the stream F of hot gases pass through communication points (openings) 11 into a nozzle box 5. With reference to FIG. 6, it can then be seen how hot fluid F streams out of the nozzle boxes 5 through the openings 7 and towards the cylindrical surface 3 of the Yankee drying cylinder 2 and thereby also towards the fibrous web W that travels on the surface of the cylindrical surface 3 (the fibrous web W is not shown in FIG. 3). It will be noted (see FIG. 6) that the openings 7 in the nozzle boxes 5 are facing the circular cylindrical surface 3 of the Yankee drying cylinder 2. The nozzle boxes 5 are normally spaced from the cylindrical surface 3 of the Yankee drying cylinder 2 by a distance "t" which, in many realistic embodiments, may be 15 mm-50 mm or on the order of about 15 mm-50 mm but other numerical values are also possible. Generally, it is desirable that the distance "t" between the nozzle boxes 5 and the cylindrical surface 3 should be small since a smaller distance "t" tends to increase the drying effect. Tests have been made that indicate that the final dry content of the web W reaches about 86% when the distance "t" is 50 mm and that the final dry content reaches a value of about 94% if the distance "t" between the nozzle boxes 5 and the cylindrical surface 3 of the Yankee drying cylinder 2 is reduced to 20 mm. The test results are, of course, dependent also on other conditions such as, for example, the temperature of the hot air but a smaller distance "t" from the nozzle boxes 5 to the surface 3 of the Yankee increases the drying effect. In theory, the distance "t" should be as small as possible to achieve the best possible drying effect. However, since the temperature of the Yankee drying hood arrangement will normally reach a level of several hundred degrees centigrade, it must be taken into account that deformation of the arrangement may occur. For safety reasons, i.e. in order to ensure that the Yankee drying hood arrangement will not come into direct contact with the Yankee drying cylinder, the distance "t" must therefore have a certain minimum value. In many practical embodiments, the minimum value for the distance t may be 15 mm. In order to get maximum drying effect, the distance "t" is then selected to be the same for all nozzle boxes. With reference to FIG. 3 FIG. 6, FIG. 7 and FIG. 8, it can be seen how one and the same distributor conduit 8 communicates with several nozzle boxes 5 such that several different nozzle boxes 5 are supplied with hot fluid from one and the same distributor conduit 8. With reference to FIG. 3, FIG. 7, FIG. 8 and FIG. 9, it can be seen that there is a plurality of distributor conduits 8 and it can be seen how the distributor conduits 8 extend in the circumferential direction S such that nozzle boxes 5 along different positions along the circumference of the curved structure 6 can be supplied with a hot fluid F (such as hot air). Thereby, hot fluid F (such as hot air) can reach the fibrous web W at different locations along the circumference of the Yankee drying cylinder 2. It may be noted that, in FIG. 4 and FIG. 6, the circumferential direction of the curved structure is indicated with the arrow "S" which has a direction that coincides with the machine direction, i.e. the direction in which the fibrous web is moving over the Yankee drying cylinder 2. With reference to FIG. 6, it can also be seen how there is a distance "t" that separates the nozzle boxes 5 from the surface 3 of the Yankee drying cylinder 2. In realistic embodiments, it will normally be so that the distance "t" is the same for all nozzle boxes 5 such that the drying effect is maximized. However, embodiments are conceivable in which the distance "t" is not identically the same for all nozzle boxes 5.

With reference to FIG. 3 and FIG. 4, it may be noted that the distributor conduits have a larger dimension (i.e. a greater extension in the radial direction away from the imaginary axis X) in the area where they are connected to the main supply conduit(s) 9, 10 and become narrower further away from the area in which they first receive hot fluid (such as air). This is because the amount of hot fluid (e.g. hot air or gas) should preferably be the same or substantially the same to all nozzle boxes 5. As the hot fluid moves in the distributor conduits 8 away from the area where the first receive hot fluid from the main supply conduit(s) 9, 10, hot fluid F leaves the distributor conduits 8 and the volume flow gradually decreases. To achieve a substantially equal flow of hot fluid F to each nozzle box 5, the distributor conduits are suitably (but not necessarily) made narrower at their ends. While patent drawings such as FIG. 4 are normally to be understood as schematic, the part of FIG. 4 that shows how the distributor conduits 8 become narrower at their respective ends can be interpreted as an example of a realistic embodiment.

The inventors have found that such Yankee drying hood arrangements can make a significant contribution to the drying on the Yankee drying cylinder 2. However, it is a known problem that, in the cross machine direction (the CD direction), heating of the web W may be uneven which can result in undesirable variations in dryness in the CD-direction.

Figure 13:
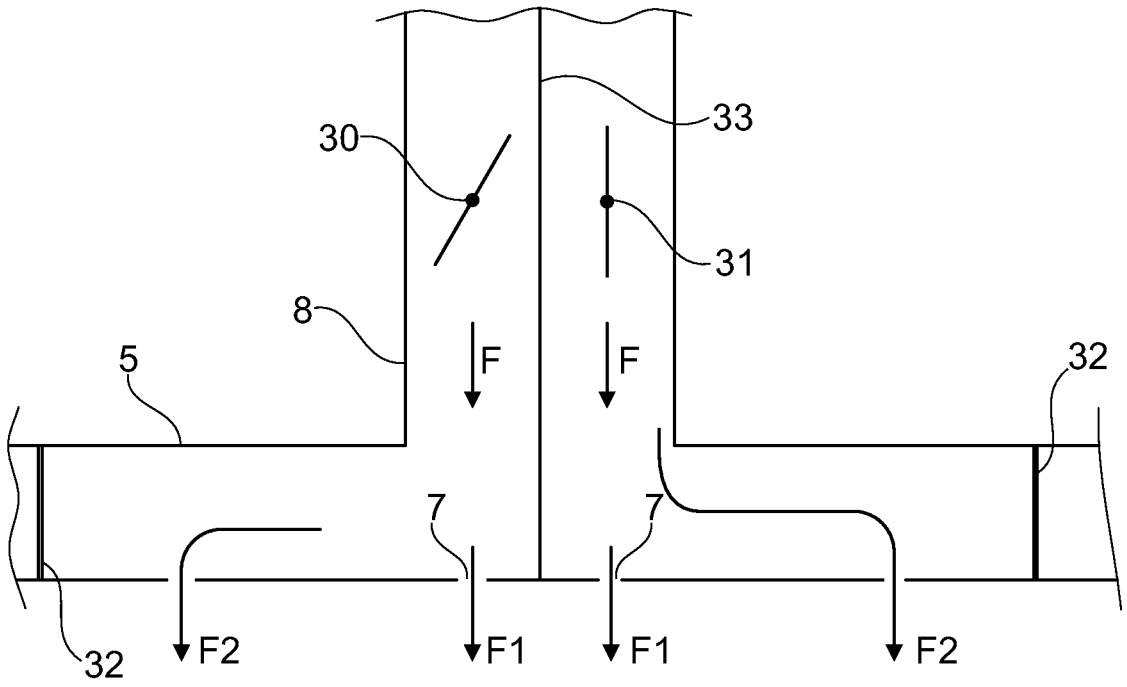
FIG. 13 is a schematic representation of the technical problem underlying the invention.

The inventors have now found that the heating effect of the drying nozzles 5 is somewhat higher in the area below the point where a specific drying nozzle 5 receives hot fluid from a distributor conduit 8. Without wishing to be bound by theory, the inventors believe that the explanation is that the temperature of the hot fluid F decreases somewhat as the hot fluid travels through the drying nozzles 5 in the cross machine direction (i.e. in the longitudinal direction L of each drying nozzle). This can be explained with reference to FIG. 13. FIG. 13 shows (schematically) a distributor conduit 8 which has been divided into two parts separated from each other by a separating wall 33 and in each part, there is a damper 30, 31 that can be opened or closed. Preferably, the dampers 30, 31 can be opened or closed independently of each other. The purpose of the dampers 30, 31 is to control the flow of hot fluid F. In FIG. 13, the left damper 30 is shown in a partially closed position such that only a reduced amount of hot fluid F can pass while the second damper 31 is shown in a completely open position such that hot fluid (in particular hot air) can pass unobstructed. It should be understood that embodiments are possible in which the distributor conduits 8 are not divided by a separating wall and each distributor conduit 8 has only one damper. It should be understood that the dampers 30, 31 are optional even though they are considered very useful for controlling the flow of hot fluid F. The damper or dampers 30, 31 may be present in some or all distributor conduits 8 and may advantageously be connected to control equipment such as a computer that controls opening or closing of the damper(s) 30, 31, for example in response to measurements of dryness profile made on the web W that comes from the Yankee drying cylinder 2. The nozzle boxes 5 may advantageously (but not necessarily) be divided in their longitudinal direction (the CD direction) into separate compartments by dividing walls 32. The dividing walls 32 contribute to counteract temperature variations in the hot fluid F that leaves the openings 7 in the nozzle boxes 5. The dividing walls 32 can thus divide the nozzle boxes 5 (or a nozzle box 5) into separate parts that can be supplied with hot fluid F independently of each other. It should be understood that there may be many embodiments in which such dampers 30 and 31 are not used. In such embodiments, the dividing walls 32, 33 are normally not needed. A hot fluid F (such as hot air) comes through a distributor conduit 8 and reaches a nozzle box 5. In many realistic embodiments, the temperature of the hot fluid F (normally hot air) may be about 500° C. In the area of the nozzle box 5 where the hot air first comes into the nozzle box 5, the hot air can leave the nozzle box 5 through openings 7 at a temperature that is still almost 500° C. which is indicated by the arrows F1. Further away from the area where the hot air comes in to the nozzle box 5, the hot air has cooled somewhat and leaves the nozzle box 5 through openings 7 which is indicated by the arrows F2. The hot air represented by the arrow F1 is still almost about 500° C. but the temperature of the hot air represented by the arrows F2 is somewhat lower. Depending on the circumstances in each specific case, the decrease in temperature may vary, but if the air represented by the arrows F1 has a temperature of 500° C. or about 500° C., it may be realistic to expect that the temperature of the air represented by the arrows F2 may have dropped to a level in the range of 480° C.-490° C. For example, the temperature of the air represented by the arrows F2 may have dropped to 485° C. As a consequence, the drying effect will become uneven which may result in a less even moisture profile of the web W in the CD direction. It should be noted that the above indicated temperature of 500° C. is only mentioned as an example and that the temperature of the hot fluid (e.g. hot air) that comes through the main supply conduit(s) may have other values. The actual value for the temperature drop may of course depend on a number of factors such as, for example, air speed and the distance over which the hot air must travel in the CD direction. The number of distributor conduits 8 per meter width of the curved structure 6 is thus also a factor. For example, if there are only two distributor conduits 8 per meter width, the decrease in temperature will be greater than if there are four distributor conduits 8 per meter width of the curved structure 6 (all other things being equal). Typical values for the temperature of the air from the main supply conduit(s) may be in the range of, for example, 300° C.-500° C. If the original temperature is only 300° C., the temperature drop may be somewhat lower than indicated above but there will still be a temperature drop and the problem of temperature drop (decrease in temperature) of the hot fluid in the CD direction remains. This leads to uneven heating of the web W in the cross machine direction CD which may have a negative effect on the moisture profile or make it more difficult to achieve the desired even moisture profile. The moisture profile is not determined by the Yankee drying hood alone and it may also be influenced by, for example, pressing that takes place before the fibrous web reaches the Yankee drying cylinder. The inventors are aware that various steps can be taken both outside the Yankee drying hood and also with regard to the design and operation of the Yankee drying hood to improve the moisture profile. However, the inventors of the present invention have found that it is desirable to provide a solution that further improves the moisture profile and that this can be achieved by a novel design feature of the Yankee drying hood.

To solve the technical problem of achieving a more even drying of the fibrous web in the cross machine direction CD, the inventors have decided that the orientation of the distributor conduits 8 should be changed. Conventionally, the distributor conduits are arranged such that they simply follow the machine direction and are thus oriented at 90° to the nozzle boxes 5 (and thereby also at an angle of 90° the imaginary axis X around which the drying nozzles are distributed). However, according to the invention, the distributor conduits 8 should instead be oriented around the curved structure 6 of the nozzle boxes 5 in such a pattern that, when one and the same distributor conduit 8 communicates with different nozzle boxes 5, it does so at different points along the longitudinal extension L of the different nozzle boxes 5, i.e. at points separated from each other not only in the circumferential direction of the curved structure 6 but separated from each other (spaced apart from each other) also in the direction of the longitudinal extension of the curved structure and thereby also separated from each other in the direction of the axial extension/length A of the Yankee drying cylinder 2 (the cross machine direction CD) when the Yankee drying hood arrangement 1 is fitted over a Yankee drying cylinder 2. In other words, when a distributor conduit 8 communicates with a first nozzle box 5 and a second nozzle box 5 which is separated from the first nozzle box 5 in the circumferential direction of the curved structure 6, the distributor conduit 8 will do this at points spaced apart from each other in the direction of the longitudinal extension of the nozzle boxes 5. As a consequence, a part of the cylindrical surface 3 of the Yankee drying cylinder 2 (and a corresponding part of the fibrous web W) that passes one nozzle box 5 and is exposed to hot air having a slightly varying temperature profile in the cross machine direction will then pass a following nozzle box 5 and be exposed to hot air which likewise has a slightly varying temperature profile but which is displaced in the CD direction (the direction in which the nozzle boxes 5 have their longitudinal extension) such that a part of the cylindrical surface 3 (and the fibrous web W on it) that is exposed to (relatively) less hot air as it passes one nozzle box 5 will be exposed to (relatively) hotter air as it passes a following nozzle box 5.

The invention can take different forms and one way of achieving the desired result could be to arrange the distributor conduits 8 such that they follow a meandering or zig-zag path around the curved structure 6 formed by the nozzle boxes 5.

However, in a preferred embodiment of the invention, the distributor conduits 8 are helically oriented around the curved structure 6 formed by the nozzle boxes 5.

Figure 8:
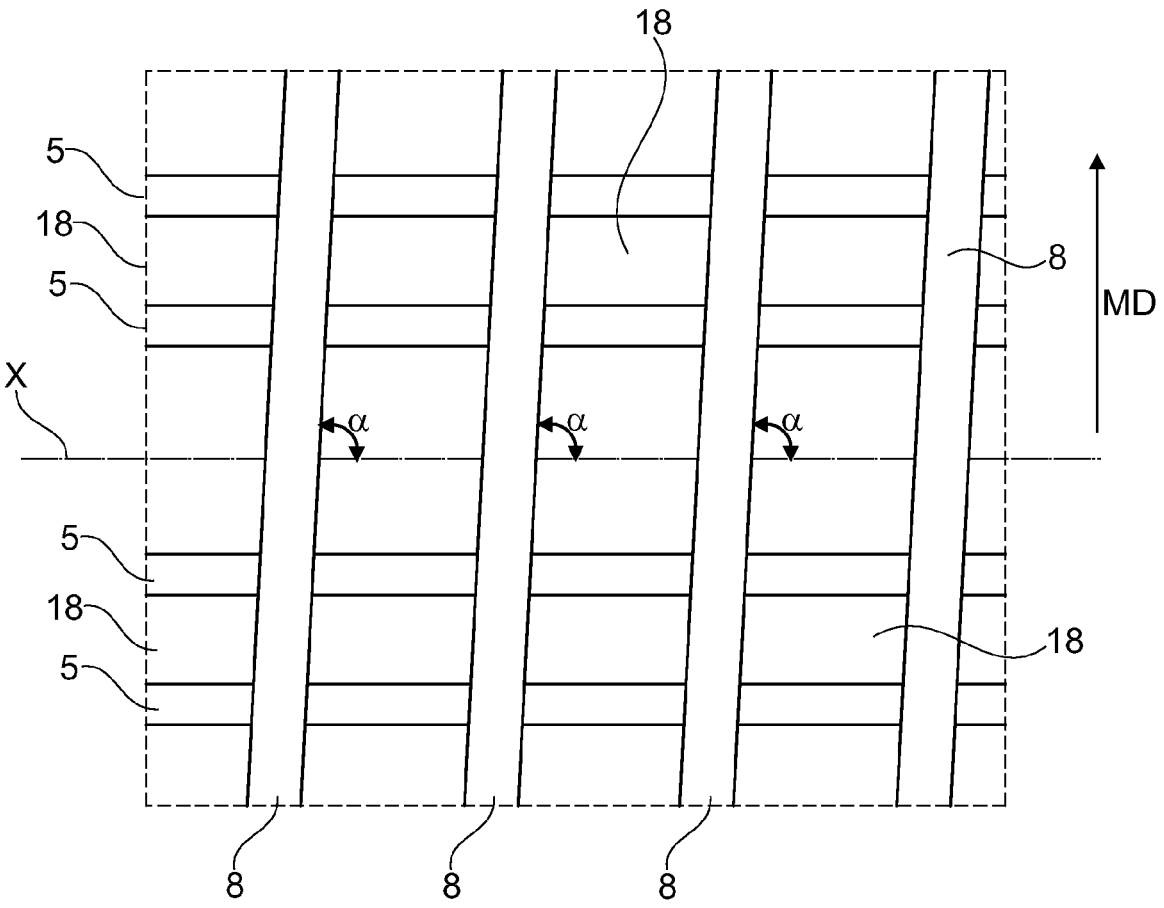
FIG. 8 is a schematic representation of some of the distributor conduits and some of the nozzle boxes as seen in a direction towards the Yankee drying cylinder.
Figure 9:
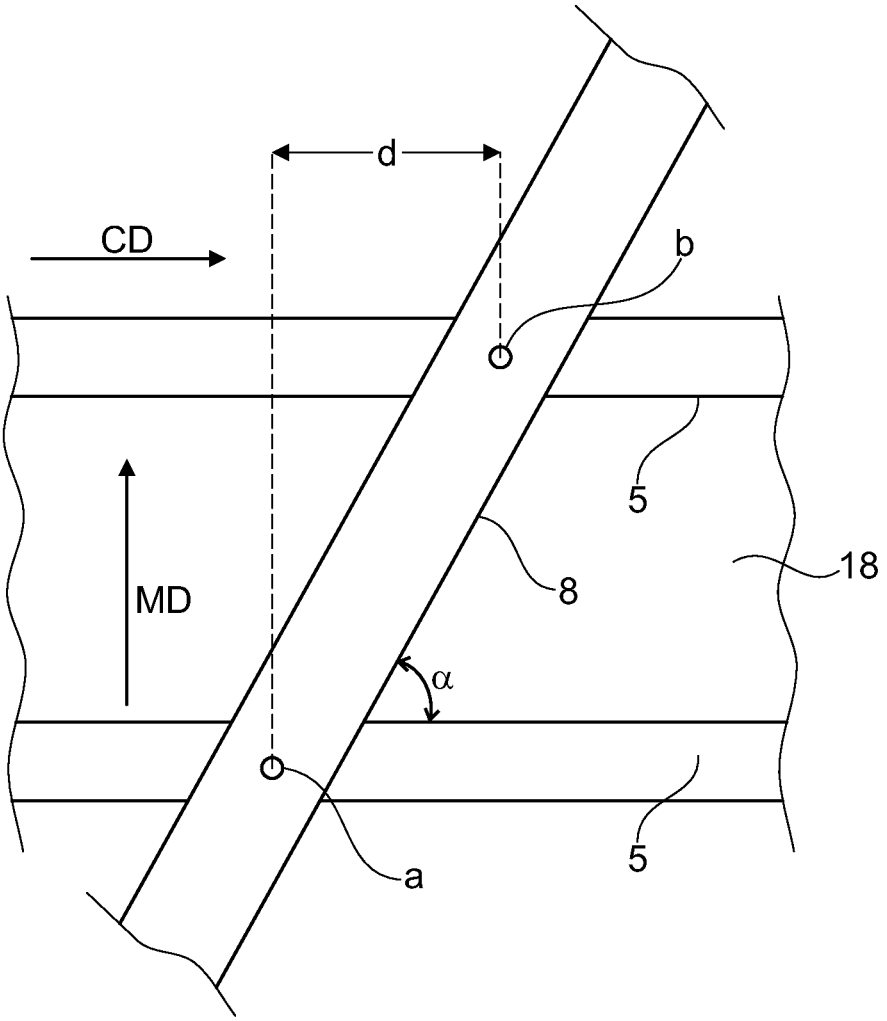
FIG. 9 shows in greater detail some of the parts shown in FIG. 8.

How the technical problem can be solved will now be explained in greater detail in the following. With reference to FIG. 7, FIG. 8 and FIG. 9, the distributor conduits 8 are arranged such that, in the circumferential direction S of the curved structure 6 formed by nozzle boxes 5, the distributor conduits 8 form an angle $\alpha$ with the imaginary axis X around which the nozzle boxes 5 are distributed. In many realistic embodiments of the invention, the distributor conduits 8 may form an angle $\alpha$ of 89°-60° with the imaginary axis X around which the nozzle boxes 5 are distributed. For example, the distributor conduits 8 may form an angle of 87°-70° with the imaginary axis X.

The effect of this way of arranging the distributor conduits will now be explained with reference to FIG. 9. In FIG. 9, a distributor conduit 8 is shown that supplies two separate nozzle boxes 5 with a hot fluid F (in particular hot air or some other hot gas). It should be understood that a fibrous web W is travelling in the machine direction MD. At a first nozzle box 5, the distributor conduit 8 supplies the first drying nozzle 5 with hot fluid in the area of the point indicated by "a". Since the distributor conduit 8 is arranged in a helical pattern, it forms an angle $\alpha$ both with regard to the imaginary axis X around which the nozzle boxes 5 are oriented and also with the nozzle boxes 5 themselves. As a consequence, the distributor conduit 8 will come into communication with the subsequent nozzle box 5 in the area of the point indicated by "b". In the cross machine direction (the CD direction), the point indicated by "b" is offset by the distance "d" with respect to the point indicated by "a". As a consequence, the point along the CD direction at which the hot fluid F enters the nozzle box 5 has been somewhat displaced in relation to where it enters the previous nozzle box 5 (at the point indicated "a"). This means the temperature distribution and heating effect can be evened out to a considerable degree in the CD direction (which is also the direction of the longitudinal extension L of the nozzle boxes 5) since unevenness in the heating effect produced by one nozzle box 5 is compensated for by the heating pattern of the following nozzle box(es) 5.

Without wishing to be bound by theory, it is believed by the inventors that the inventive Yankee drying hood arrangement can be expected to result in not only a more even temperature distribution but also in a corresponding compensation in the impingement velocity profile as the hot air contacts the web (as hot air travels in the CD direction through the nozzle boxes 5, air speed and static pressure may be affected resulting in variations in the impingement velocity profile).

With reference to FIG. 3 and FIG. 4, the Yankee drying hood arrangement may have more than one main supply conduit 9, 10. In the embodiment of FIG. 3 and FIG. 4, the Yankee hood drying arrangement has a first main supply conduit 9 and a second main supply conduit 10 and each main supply conduit 9, 10 is connected to its own set of distributor conduits 8. The main supply conduits 9, 10 are normally oriented parallel to the imaginary axis X, i.e. perpendicular to the machine direction MD but other orientations of the main supply conduit(s) 9, 10 are conceivable.

With particular reference to FIG. 4, it can be seen that an embodiment is possible in which, in the circumferential direction S (in FIG. 4, the circumferential direction indicated by the arrow S should be understood as being the machine direction, i.e. the direction along which the fibrous web W passes through the machine) of the curved structure 6 formed by the nozzle boxes 5, the Yankee drying hood arrangement is divided into a first part 21 and a second part 22. The first part 21 is here the part where the fibrous web first is exposed to the Yankee drying hood arrangement 1 and the arrow S that indicates the circumferential direction of the curved structure 6 also indicates the direction of travel of the fibrous web W, i.e. it is the machine direction MD. The first part 21 may be referred to as the "wet end" WE of the Yankee drying hood arrangement and the second part 22 may be referred to as the "dry end" (the fibrous web W contains less water when it reaches the second part 22 than it contains when it first enters the first part 21). The Yankee drying hood arrangement 1 may then be designed such that the first part 21 has its own main supply conduit 9 which is connected to its own set of distributor conduits 8 and drying nozzles 5 while the second part 22 also has its own main supply conduit 10 which is in communication with its own set of distributor conduits 8. In many practical embodiments, the number of distributor conduits 8 in the first part 21 may be greater than the number of distributor conduits 8 in the second part 22. One reason for this is that it is often desirable to put greater effort into profiling in the first part 21 (i.e. the wet end of the Yankee drying hood arrangement). The distributor conduits 8 often contain dampers for profiling for controlling the air flow through the distributor conduits 8 and to ensure a good profiling (with regard to dryness) it is often deemed suitable to use a larger number of distributor conduits 8 in the first part 21 where the fibrous web W contains more water. For example, in the first part 21 of the Yankee drying hood arrangement, there may be 2-4 distributor conduits 8 per meter width of the curved structure 6 where the width of the curved structure 6 is measured in the direction of the imaginary axis around which the nozzle boxes 5 are distributed and in the second part 22, there may be 1-2 distributor conduits 8 per meter width of the curved structure 6. However, other numerical values are also possible. For example, embodiments are conceivable in which the second part 22 has fewer than 1-2 distributor conduits per meter width of the curved structure 6.

In this context, it may be noted that the greatest drying effect of the Yankee drying hood arrangement normally takes place in the first part 21 (i.e. in the wet end WE). Generally, more than 50% of the drying effect takes place in the wet end (i.e. in the first part 21 when the Yankee drying hood arrangement is divided into two parts) and it has been estimated that in some cases as much as 70% of the drying effect may take place in the wet end. Therefore, the invention is of especial value in the wet end WE, i.e. in the first part 21 when the drying hood arrangement is divided into two parts 21, 22.

The reason that the Yankee drying hood arrangement is often divided into two parts 21, 22 (often referred to as "sections") is that the total wrap angle of the Yankee drying hood arrangement (i.e. the part of the circumference of the Yankee drying hood that is covered by the Yankee drying hood arrangement) is very often larger than 180 degrees and it would be impossible or at least very difficult to mount the Yankee drying hood arrangement 1 on the Yankee drying cylinder 2 or to retract the Yankee drying hood arrangement from the Yankee drying cylinder 2 (for example in connection with service, repairs or rebuilds) if the Yankee drying hood arrangement 1 was not divided into two parts (sections) 21, 22. However, it should be understood that embodiments are conceivable in which the wrap angle is so small that the Yankee drying hood arrangement does not need to be divided into two separate parts 21, 22 but could be made as one single part and embodiments designed in one single part are conceivable.

It should also be understood that, even when the Yankee drying hood arrangement is actually divided into two parts 21, 22, the different parts 21, 22 need not necessarily have separate air systems. The air system may be designed as a so called "duo system" in which each separate part 21, 22 has its own air system (for supply of hot and evacuation of hot fluid F such as hot air) or the air system may be designed as a so called "mono system" which has only one burner (for producing hot air/gas) and one single fan. Also a Yankee drying hood arrangement with two separate parts may be designed as a "mono system". If the Yankee drying hood arrangement 1 has only one single part (a single part hood), the natural choice would normally be to use a "mono system" since it would be less practical to use a "duo system" in such a case but, in principle, a "duo" system could also be made in one single part. Embodiments are also conceivable in which the Yankee drying hood arrangement is divided into more than two parts that each has its own main supply conduit and its own distributor conduits.

The first part 21 and the second part 22 of the Yankee drying hood arrangement 1 are usually equal in size, i.e. they normally have the same extension in the circumferential direction of the curved structure 6 and the first part 21 normally has the same number of nozzle boxes 5 as the second part. However, it should be understood that embodiments are conceivable in which this is not the case. The exact number of nozzle boxes 5 and their distribution between the first part 21 and the second part 22 (first and second section 21, 22) may vary depending on the machine configuration. The first part 21 and the second part 22 may have the same number of nozzle boxes 5 or it may be so that the number of nozzle boxes 5 is larger in either the first part 21 or in the second part 22. The first part 21 may be equal in size to the second part 22 but it could also be both larger (longer in the circumferential direction S) or smaller than the second part 22 which may also affect the number of nozzle boxes 5 used in the first and second parts 21 and 22.

Preferably, the Yankee drying hood arrangement 1 comprises a box structure 13 that at least partially encapsulates the nozzle boxes 5, the distributor conduits 8 and the at least one main supply conduit 9, 10. In many realistic embodiments, the nozzle boxes 5 and the distributor conduits 8 are completely encapsulated by a box structure 13. With reference to FIG. 1 and FIG. 4, the box structure 8 may have a roof 17, a back wall 14, a front wall 15 and side walls 16. It should be understood that, in FIG. 1, the back wall 14 is located at the wet end (WE) of the Yankee drying hood arrangement where most of the drying will occur and the front wall 15 is located at the dry end (DE) of the Yankee hood drying arrangement where (in most cases) only a smaller part of the drying effect takes place. The roof 17 may then cover the nozzle boxes 5, the distributor conduits 8 and the at least one main conduit 9, 10. Preferably, the roof 17 is curved such that, when the roof faces upwards, water or other liquids that land on the roof 17 will be helped by gravity to flow off the roof 17 and thereby also contribute to cleaning the roof 17 from dust particles. It should be understood that the inventive Yankee drying hood arrangement can of course also be used in cases where the roof 17 is flat or has some other shape but the curved (convex) shape is deemed to be advantageous.

With reference to FIG. 3 and FIG. 4, it should be understood that a thermally insulating material may be placed between inside the roof 17, for example between a supporting structure for the roof 17 and the roof itself in order to reduce heat losses. Also other parts of the box structure may optionally be fitted with heat insulating material. It should be understood that the normal practice is to use such insulating materials but embodiments are conceivable in which such insulating materials are not used.

In many realistic embodiments of the invention, the curved structure 6 formed by the nozzle boxes 5 may have a radius R in the range of 1.5 m-3 m but other numerical values are also possible. The radius R corresponds to the distance between the imaginary axis X and the nozzle boxes 5. When the nozzle boxes 5 are equidistantly spaced from the imaginary axis X, this distance (the radius R) is the same for all nozzle boxes 5 (see FIG. 4). As previously mentioned, embodiments are conceivable in which the nozzle boxes 5 are not all placed at the same distance from the imaginary axis R since the distance "t" between a nozzle box 5 and the circular cylindrical surface 3 may vary slightly but since the distance "t" is very small compared to the radius R, the nozzle boxes can still be seen as substantially equidistantly spaced from the imaginary axis R.

In many realistic embodiments, the Yankee drying hood arrangement may comprise a total of 30-50 nozzle boxes 5 but another number of nozzle boxes may also be used depending on, for example the radius of the Yankee drying cylinder or the dimensions of the nozzle boxes used.

An example of a nozzle box 5 is shown in perspective in FIG. 12. The nozzle box 5 has a longitudinal extension (length) L which, when the nozzle box 5 is in use, is normally is the extension of the nozzle box 5 in the cross machine direction CD (see FIG. 2) such that, along its longitudinal extension L, the nozzle box 5 is parallel with the imaginary axis X around which the nozzle boxes are oriented and around which the Yankee drying cylinder 2 rotates. The nozzle box 5 has a height H and a length C in the circumferential direction S of the curved structure 6. In many realistic embodiments of the invention, the nozzle boxes 5 may have a length L in the longitudinal direction of 2.0 m-10 m such that the curved structure 6 formed by the nozzle boxes 5 can cover the cylindrical outer surface 3 of a Yankee drying cylinder 2 having an axial extension of 2.0 m-10 m but other numerical values are also conceivable, even values above 10 m. The height H may be, for example, 10 cm-20 cm but other numerical values are also possible. The length C in the circumferential direction may be, for example, 10 cm-30 cm but other numerical values are also possible. In many realistic embodiments, each nozzle box 5 may comprise 100-300 openings 7 per meter length in the longitudinal direction (L) of the nozzle boxes 5 but other numerical values are also conceivable. For example, it could have 80 openings per meter length or 350 openings per meter length.

The openings 7 in the nozzle boxes 5 may preferably have a circular cylindrical shape but other shapes are also conceivable, for example rectangular or oval. For openings 7 with a circular cylindrical shape, each opening 7 in the nozzle boxes 5 may have a diameter in the range of 2 mm-10 mm, preferably 3 mm-7 mm but other dimensions are also possible and may depend on, for example, the number of openings 7.

With reference to FIG. 6, FIG. 7, FIG. 8 and FIG. 9 there are empty spaces/gaps 18 between the nozzle boxes 5 such that the nozzle boxes 5 are spaced apart from each other in the circumferential direction of the curved structure 6 formed by the nozzle boxes 5. In this way, a fluid such as air or a mixture of air and steam can pass between the nozzle boxes 5. Preferably, the nozzle boxes 5 are spaced from each other by a distance of 30 mm-70 mm in the circumferential direction of the curved structure 6 formed by the nozzle boxes 5. In the circumferential direction of the curved structure 6, the distance between different nozzle boxes is not necessarily the same for all nozzle boxes. For example, in the wet end WE, the distance in the circumferential direction between different nozzle boxes may be smaller than what is the case in the dry end DE. It could also be so that, in a part of the wet end WE, the distance is smaller than in the rest of the wet end WE. However, embodiments are also conceivable in which the distance in the circumferential direction of different nozzle boxes is the same for all nozzle boxes.

Figure 11:
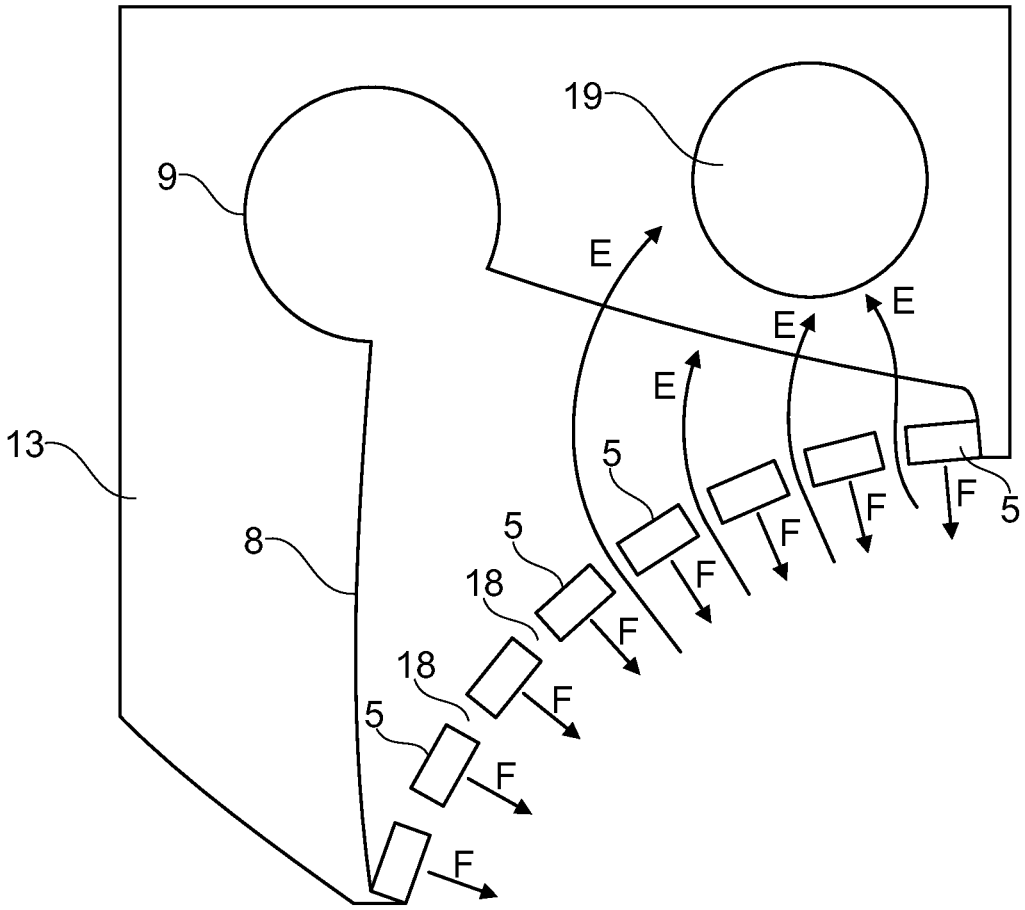
FIG. 11 is a schematic representation of how a fluid such as hot air exits the nozzle boxes and is subsequently evacuated.

With reference to FIG. 10 and to FIG. 11, there is at least one evacuation conduit 19 that is connected to a source of underpressure which has been symbolically indicated as a fan 20 (or several fans 20) in FIG. 10. When underpressure is applied to the evacuation conduit(s) 19, air or a mixture of air and steam from the Yankee drying hood arrangement can be evacuated. Hot air (or gas) which has been used to dry the fibrous web W can be sucked out between the empty spaces/gaps 18 between the nozzle boxes 5 and evacuated through the evacuation conduit(s) 19. In FIG. 10, separate fans 28 for the supply of hot fluid F (such as hot air) are shown together with separate fans 20 for evacuation of a mixture of air and steam. It should be understood that this way of illustrating the arrangement is made only as a schematic representation of the principles of supply and evacuation. In many realistic embodiments, one and the same fan can be used both for supplying hot air (or air to be heated) and for evacuating a mixture of spent hot air and steam. It should thus be understood that the fans 20 may, in many embodiments, be identical to the fans 28. Embodiments are also conceivable that include only a single fan 20/28 that serves both to supply the entire Yankee drying hood arrangement with fluid (e.g. air) and to evacuate gas/air and steam through the evacuation conduit(s) 19. It can be noted in FIG. 11 how streams of hot fluid F (such as hot air) streams from the nozzle boxes 5 and how a mixture of spent hot fluid F and evaporated water (steam) is evacuated through the gaps 18 between the nozzle boxes 5 as indicated by the arrows E and how the stream of evacuated gases and steam flow towards the evacuation conduit 19. The air that is evacuated through the evacuation conduit(s) 19 may have a temperature of, for example about 350° C. In FIG. 10, the wet end is indicated WE and the dry end is indicated as DE. Normally, it is to be expected that about 60-70% of the evaporation effect takes place in the wet end WE of the Yankee drying hood arrangement (corresponding to the first part 21) and that 30-40% of the evaporation occurs in the dry end DE corresponding to the second part 22 but these values are only given as a rough estimate and may vary depending on operating conditions, machine dimensions and other factors. However, since it is unavoidable that most of the drying effect takes place in the early stages (i.e. at the wet end WE), it is necessary to ensure that the distributor conduits 8 are arranged in such a way that one and the same distributor conduit 8 communicates with different nozzle boxes 5 at different points along the longitudinal extension of the different nozzle boxes 5, i.e. at different points in the CD direction (i.e. in the direction of the axis X in FIG. 1 and FIG. 8).

It should be understood that the invention can also be defined in terms of a Yankee drying cylinder 2 which has been fitted with a Yankee drying hood arrangement as described above and wherein the Yankee drying cylinder 2 is rotatably journalled in the bearings 24 such that it can rotate about an axis of rotation X which coincides with the imaginary axis X around which the nozzle boxes 5 are distributed such that the nozzle boxes 5 extend along the outer cylindrical surface 3 of the Yankee drying cylinder 2 and can deliver hot fluid (such as hot air or a mixture of air And combustion gases) towards the outer cylindrical surface 3 of the Yankee drying cylinder 2 along the axial extension A of the Yankee drying cylinder 2.

It should also be understood that, while the invention has been described above in terms of a Yankee drying hood arrangement and a Yankee drying cylinder, the invention may also be defined in terms of a method of operating such an arrangement and such a Yankee drying cylinder and such a method would include feeding a wet fibrous web to the circular cylindrical surface of the Yankee drying cylinder and performing the steps that would be the inevitable result of operating the arrangement and the Yankee drying cylinder in the way described above.

The invention can thus be defined as a method of drying a fibrous web W on a Yankee drying cylinder 2 which Yankee drying cylinder has an axial extension A and a circular cylindrical surface 3. As explained above the Yankee drying cylinder is rotatably journalled such that it can rotate about an axis of rotation X and the Yankee drying cylinder 2 cooperates with a Yankee drying hood arrangement 1 which is fitted over the Yankee drying cylinder such that the Yankee drying hood arrangement 1 covers a part 4 of the circular cylindrical surface 3 of the Yankee drying cylinder 2. As previously explained, the Yankee drying hood arrangement 1 comprises a plurality of nozzle boxes 5 distributed around the axis of rotation X of the Yankee drying cylinder 2 such that, when the Yankee drying hood arrangement 1 is fitted over the Yankee drying cylinder 2, the nozzle boxes 5 are spaced from the circular cylindrical surface 3 of the Yankee drying cylinder 2 but form a curved structure 6 that follows the outer contour of the circular cylindrical surface 3 of the Yankee drying cylinder 2. Each nozzle box 5 has a longitudinal extension in a direction parallel to the axial extension A of the Yankee drying cylinder 2 and each nozzle box 5 has a plurality of openings 7 distributed along the longitudinal extension of the nozzle box 5. Through the openings 7, a fluid such as hot air can exit the nozzle boxes 5 and stream towards the circular cylindrical surface 3 of the Yankee drying cylinder 2 at different points along the longitudinal extension of each nozzle box 5. In this way, the fluid streaming from the openings 7 can reach the circular cylindrical surface 3 of the Yankee cylinder 2 and the fibrous web W that travels on the circular cylindrical surface 3. During drying of the fibrous web W, hot fluid F is supplied to each nozzle box 5 at different points along the longitudinal extension of the nozzle box 5 such that hot fluid delivered to the nozzle boxes 5 can stream from the nozzle boxes 5 towards the cylindrical surface 3 and the fibrous web W. In the inventive method, at least two nozzle boxes 5 are supplied with hot fluid F at different points in the longitudinal direction of the nozzle boxes 5 (i.e. at different axial positions in relation to the axis of rotation X of the Yankee drying cylinder) such that, in the longitudinal direction of the nozzle boxes 5, the points on one nozzle box 5 at which hot fluid F is supplied to that nozzle box 5 are spaced apart in the longitudinal direction of the nozzle boxes 5 from the points on at least one other nozzle box 5 where hot fluid is supplied to said other nozzle box 5. In this way, differences in temperature in the cross machine direction will be compensated. Regions of the fibrous web that are dried with slightly less hot air as they pass one nozzle box 5 will be dried by air jets that have a slightly higher temperature as these regions pass the next nozzle box 5.

It should be understood that the categories "Yankee drying hood arrangement", "Yankee Drying cylinder and "method of drying a fibrous web" only reflect different aspects of one and the same invention.

Thanks to the invention, a fibrous web can be produced that has a more uniform dryness in the cross machine direction when it leaves the Yankee drying cylinder, i.e. a more even moisture profile.

The invention claimed is:

1. A Yankee drying hood arrangement (1) which is shaped to be fitted over a Yankee drying cylinder (2) having an axial extension (A) and a circular cylindrical surface (3) such that the Yankee drying hood arrangement (1) can cover a part (4) of the circular cylindrical surface (3) of the Yankee drying cylinder (2), the Yankee drying hood arrangement (1) comprising:

a plurality of nozzle boxes (5) distributed around an imaginary axis (X) such that, when the Yankee drying hood arrangement (1) is fitted over a Yankee drying cylinder (2), the nozzle boxes (5) are spaced from the circular cylindrical surface (3) of the Yankee drying cylinder (2) but form a curved structure (6) that follows an outer contour of the circular cylindrical surface (3) of the Yankee drying cylinder (2), each nozzle box (5) having a longitudinal extension in a longitudinal direction parallel to the axial extension (A) of the Yankee drying cylinder (2) and each nozzle box (5) having a plurality of openings (7) distributed along the longitudinal extension of the nozzle box (5) through which openings (7) a fluid can exit the nozzle boxes (5) and stream towards the circular cylindrical surface (3) of the Yankee drying cylinder (2) at different points along the longitudinal extension of each nozzle box (5) such that fluid streaming from the openings (7) can reach the circular cylindrical surface (3) of the Yankee drying cylinder (2) at different points along the axial extension of the Yankee drying cylinder (2);

a plurality of distributor conduits (8) for a fluid, the distributor conduits (8) extending in an circumferential direction of the curved structure (6) formed by the nozzle boxes (5) and each distributor conduit (8) being in communication with several nozzle boxes (5) such that the fluid can stream from each distributor conduit (8) to several different nozzle boxes (5); and at least one main supply conduit (9, 10) for a fluid, the at least one main supply conduit (9, 10) being in communication with the distributor conduits (8) such that the fluid can stream from the at least one main supply conduit (9, 10) to the distributor conduits (8), wherein the distributor conduits (8) are oriented around the curved structure (6) of the nozzle boxes (5) in such a pattern that, when one and the same distributor conduit (8) communicates with different nozzle boxes (5), the one and the same distributor conduit (8) does so at different points along the longitudinal extension of the different nozzle boxes (5).

2. A Yankee drying hood arrangement (1) according to claim 1, wherein the distributor conduits (8) are helically oriented around the curved structure (6) formed by the nozzle boxes (5).

3. A Yankee drying hood arrangement (1) according to claim 2, wherein, in the circumferential direction of the curved structure (6) formed by nozzle boxes (5), the distributor conduits (8) form an angle (a) of 89°-60° with the imaginary axis (X) around which the nozzle boxes (5) are distributed.

4. A Yankee drying hood arrangement (1) according to claim 1, wherein the Yankee drying hood arrangement (1) has at least two main supply conduits (9, 10) and wherein each main supply conduit (9, 10) is connected to a corresponding set of distributor conduits (8).

5. The Yankee drying hood arrangement (1) according to claim 1, wherein the Yankee drying hood arrangement comprises a box structure (13) that at least partially encapsulates the nozzle boxes (5), the distributor conduits (8), and the at least one main supply conduit (9, 10).

6. A Yankee drying hood arrangement (1) according to claim 1, wherein the nozzle boxes (5) are spaced apart from each other in the circumferential direction of the curved structure (6) formed by the nozzle boxes (5) such that a fluid can pass between the nozzle boxes (5).

7. A Yankee drying hood arrangement (1) according to claim 6, wherein an evacuation conduit (19) is arranged to evacuate the fluid from the Yankee drying hood arrangement and wherein the evacuation conduit (19) is connected to a source of underpressure (20).

8. A Yankee drying hood arrangement (1) according to claim 1, wherein the curved structure (6) formed by the nozzle boxes (5) has a radius in the range of 1.5 m-3 m.

9. A Yankee drying hood arrangement (1) according to claim 1, wherein the Yankee drying hood arrangement comprises 30-50 nozzle boxes (5).

10. A Yankee drying hood arrangement (1) according to claim 1, wherein the nozzle boxes (5) have a length in the longitudinal direction of 2.0 m-10 m such that the curved structure (6) formed by the nozzle boxes (5) can cover the circular cylindrical surface (3) of a Yankee drying cylinder (2) having an axial extension of 2.0 m-10 m and wherein each nozzle box (5) comprises 100-300 openings (7) per meter length in the longitudinal direction of the nozzle boxes (5).

11. A Yankee drying hood arrangement according to claim 1, wherein each opening (7) in the nozzle boxes (5) has a diameter in the range of 2 mm-10 mm.

12. A Yankee drying hood (1) arrangement according to claim 4, wherein, in the circumferential direction of the curved structure (6) formed by the nozzle boxes (5), the Yankee drying hood arrangement (1) is divided into a first part (21) and a second part (22), the first part (21) having 2-4 distributor conduits (8) per meter width of the curved structure (6) where the width of the curved structure (6) is measured in the direction of the imaginary axis around which the nozzle boxes (5) are distributed; and the second part (22) having 1-2 distributor conduits (8) per meter width of the curved structure (6).

13. A Yankee drying hood arrangement according to claim 1, wherein the nozzle boxes (5) are divided in their longitudinal direction by dividing walls 32 into separate parts that can be supplied with hot fluid (F) independently of each other.

14. A Yankee drying hood arrangement (1) according to claim 5, wherein the box structure (13) comprises a roof (17) that covers the nozzle boxes (5), the distributor conduits (8) and the at least one main conduit and wherein the roof (17) is curved such that, when the roof faces upwards, water or other liquids that land on the roof (17) will be helped by gravity to flow off the roof (17).

15. A Yankee drying cylinder (2) which has been fitted with a Yankee drying hood arrangement according to claim 1 and wherein the Yankee drying cylinder (2) is rotatably journalled such that it can rotate about an axis of rotation which coincides with the imaginary axis around which the nozzle boxes (5) are distributed such that the nozzle boxes (5) extend along the outer cylindrical surface (3) of the Yankee drying cylinder (2) and can deliver hot fluid towards the outer cylindrical surface (3) of the Yankee drying cylinder (2) along the axial extension of the Yankee drying cylinder (2).

16. A method of drying a fibrous web (W) on a Yankee drying cylinder (2) which Yankee drying cylinder has an axial extension (A) and a circular cylindrical surface (3), the method comprising rotatably journaling the Yankee drying cylinder such that the Yankee drying cylinder rotates about an axis of rotation (X) and which Yankee drying cylinder (2) cooperates with a Yankee drying hood arrangement (1) which is fitted over the Yankee drying cylinder such that the Yankee drying hood arrangement (1) covers a part (4) of the circular cylindrical surface (3) of the Yankee drying cylinder (2), the Yankee drying hood arrangement (1) comprising: a plurality of nozzle boxes (5) distributed around the axis of rotation (X) of the Yankee drying cylinder (2) such that, when the Yankee drying hood arrangement (1) is fitted over a Yankee drying cylinder (2), the nozzle boxes (5) are spaced from the circular cylindrical surface (3) of the Yankee drying cylinder (2) but form a curved structure (6) that follows an outer contour of the circular cylindrical surface (3) of the Yankee drying cylinder (2), each nozzle box (5) having a longitudinal extension in a direction parallel to the axial extension (A) of the Yankee drying cylinder (2) and each nozzle box (5) having a plurality of openings (7) distributed along the longitudinal extension of the nozzle box (5) through which openings (7) a fluid can exit the nozzle boxes (5) and stream towards the circular cylindrical surface (3) of the Yankee drying cylinder (2) at different points along the longitudinal extension of each nozzle box (5) such that fluid streaming from the openings (7) can reach the circular cylindrical surface (3) of the Yankee cylinder (2), and wherein, during drying of the fibrous web (W), hot fluid is supplied to each nozzle box at different points along the longitudinal extension of the nozzle box such that hot fluid delivered to the nozzle boxes (5) can stream from the nozzle boxes (5) towards the cylindrical surface (3) and the fibrous web (W), wherein at least two nozzle boxes (5) are supplied with hot fluid (F) at different points in the longitudinal direction of the nozzle boxes (5) such that, in the longitudinal direction of the nozzle boxes (5), the different points on one nozzle box (5) at which hot fluid (F) is supplied to that nozzle box (5) are spaced apart in the longitudinal direction of the nozzle boxes (5) from the different points on at least one other nozzle box (5) where hot fluid is supplied to said at least one other nozzle box (5).

17. The Yankee drying hood arrangement (1) according to claim 1, wherein the nozzle boxes (5) are equidistantly distributed around the axis of rotation (X).

18. The Yankee drying hood arrangement (1) according to claim 6, wherein the nozzle boxes (5) are spaced from each other by a distance of 30 mm-70 mm in the circumferential direction of the curved structure (6) formed by the nozzle boxes (5).

19. The Yankee drying hood arrangement (1) according to claim 1, wherein each opening (7) in the nozzle boxes (5) has a diameter in the range of 3 mm-7 mm.

20. The Yankee drying hood arrangement (1) according to claim 6, wherein the fluid is either air or a mixture of air and steam.

* * * * *